US012017736B2

(12) United States Patent
Kutianski

(10) Patent No.: US 12,017,736 B2
(45) Date of Patent: Jun. 25, 2024

(54) AWNING FOR PROTECTING A CARGO IN BAD WEATHER

(71) Applicant: Gustavo Giacomel Kutianski, Curitiba (BR)

(72) Inventor: Gustavo Giacomel Kutianski, Curitiba (BR)

( * ) Notice: Subject to any disclaimer, the term of this patent is extended or adjusted under 35 U.S.C. 154(b) by 580 days.

(21) Appl. No.: 17/254,684

(22) PCT Filed: Jul. 9, 2018

(86) PCT No.: PCT/BR2018/050230
§ 371 (c)(1),
(2) Date: Dec. 21, 2020

(87) PCT Pub. No.: WO2020/010414
PCT Pub. Date: Jan. 16, 2020

(65) Prior Publication Data
US 2021/0269124 A1 Sep. 2, 2021

(51) Int. Cl.

| | |
|---|---|
| ***B63B 17/02*** | (2006.01) |
| ***E04H 15/06*** | (2006.01) |
| ***E04H 15/18*** | (2006.01) |
| ***E04H 15/54*** | (2006.01) |
| ***E04H 15/64*** | (2006.01) |

(52) U.S. Cl.
CPC ..... *B63B 17/02* (2013.01); *E04H 15/06* (2013.01); *E04H 15/18* (2013.01); *E04H 15/54* (2013.01); *E04H 15/64* (2013.01)

(58) Field of Classification Search
CPC ..... B63B 17/02; B63B 17/023; E04H 15/06; E04H 15/18; E04H 15/54; E04H 15/64
See application file for complete search history.

(56) References Cited

U.S. PATENT DOCUMENTS

| | | | |
|---|---|---|---|
| 3,461,891 | A | 8/1969 | Blomberg |
| 4,022,232 | A | 5/1977 | Ross et al. |
| 5,427,491 | A | 6/1995 | Duffy et al. |

(Continued)

FOREIGN PATENT DOCUMENTS

| | | | |
|---|---|---|---|
| BR | PI0402481 | A | 2/2006 |
| BR | PI0406344 | A | 6/2006 |
| BR | 202012012772 | U2 | 9/2013 |

(Continued)

OTHER PUBLICATIONS

International Search Report from International Application No. PCT/BR2018/050230 dated Nov. 12, 2018.

*Primary Examiner* — Stephen P Avila
(74) *Attorney, Agent, or Firm* — Dorsey & Whitney LLP

(57) ABSTRACT

An awning for protecting a cargo in bad weather is disclosed, which comprises an awning arranged between a head piece and a vessel, the awning being designed, albeit not exclusively, for providing a protective covering during operations for loading vessels, more specifically for providing a protective covering for vessel holds when the hatches thereof are open. The awning is composed of a plurality of skirts, and each of these skirts comprises at least one cover, at least one flexible rod, at least one ring and at least one variable-length element. The volume of the variable-length elements may be increased or decreased by means of an external proportional control.

9 Claims, 4 Drawing Sheets

(56) References Cited

U.S. PATENT DOCUMENTS

| | | | | |
|---|---|---|---|---|
| 2003/0000154 | A1* | 1/2003 | Ignazio | E04B 1/34305 52/66 |
| 2016/0368571 | A1 | 12/2016 | Levin | |

FOREIGN PATENT DOCUMENTS

| | | | | |
|---|---|---|---|---|
| BR | MU9102972 | U2 | 10/2013 | |
| BR | 202012015291 | U2 | 10/2015 | |
| BR | 102015010713 | A2 | 7/2017 | |
| DE | 9107063.5 | U1 | 10/1992 | |
| EP | 3124704 | A1 * | 2/2017 | E02B 3/20 |
| FR | 2892377 | A1 * | 4/2007 | B63B 17/02 |

* cited by examiner

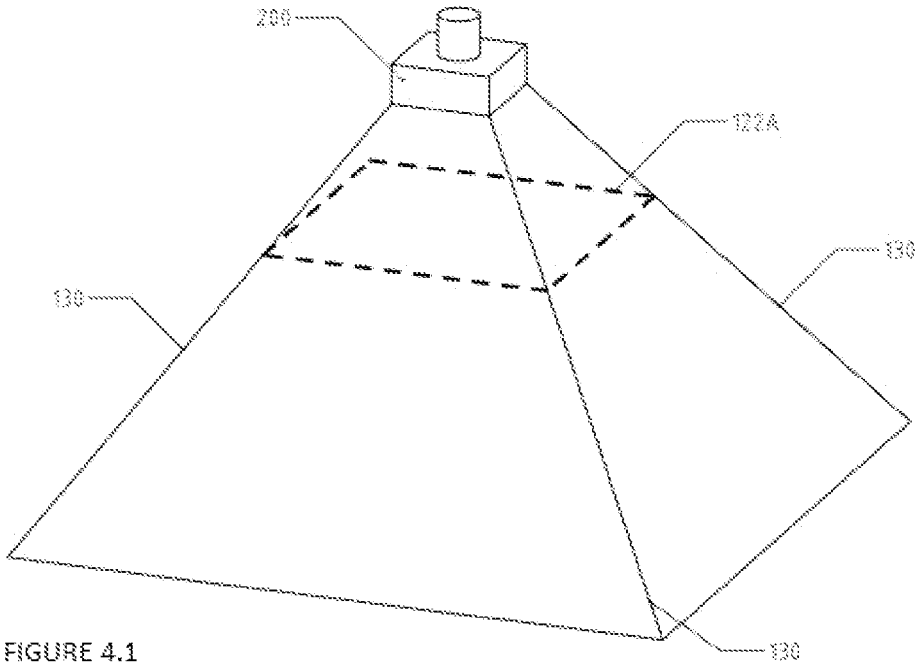
FIGURE 4.1
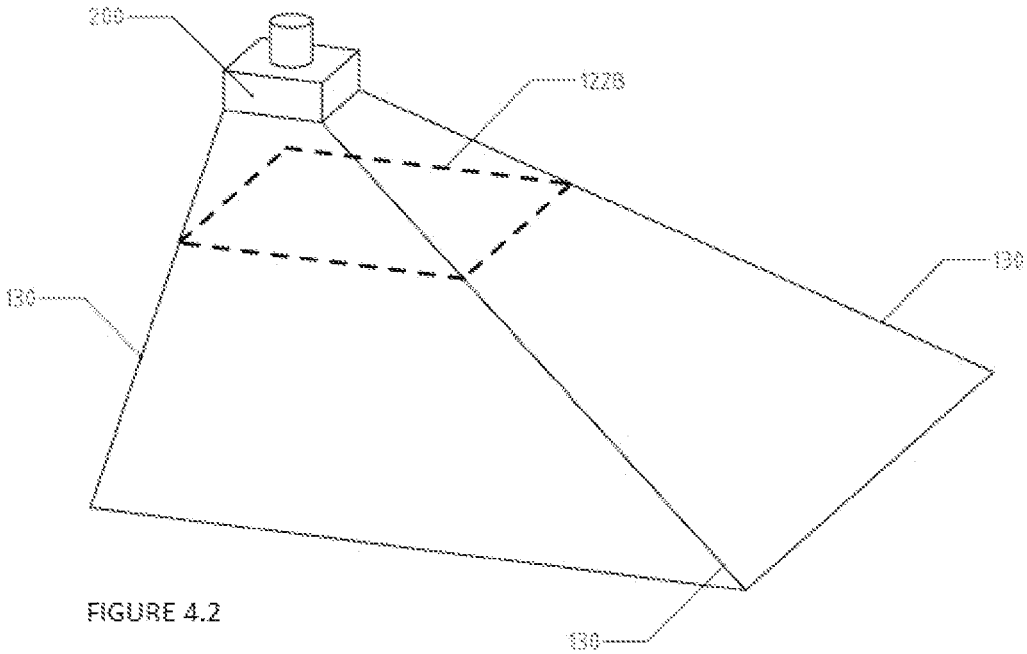
FIGURE 4.2

AWNING FOR PROTECTING A CARGO IN BAD WEATHER

FIELD OF APPLICATION

The present invention patent belongs to the field of equipment for loading and storage on vessels, notably equipment for protecting bulk cargo during loading of vessel cargo compartments.

INTRODUCTION

The present invention is related to an awning for protecting a cargo in bad weather comprising a set of radially arranged and tensed cables starting from the unloading head piece and connected to the opening of the vessel cargo compartment, having a plurality of variable-length elements by means of an external control. Covering elements are connected to these variable-length elements that allow for the unloading head piece to be moved without the influence of bad weather when loading the cargo compartment.

STATE OF THE ART

Various solutions for loading vessel cargo compartments of the nature described above are known from the state of the art.

An example is the solution revealed by the patent document BR 202012012772-0 which refers to a protection system for vessel loading equipped with a cover device consisting of an adaptable universal sheet, a coupling and operation device composed of a hoop structure which accommodates the elements necessary for the operation of the protection system, such as the fixing device, a tractor unit responsible for moving, lowering, and retracting of the protective sheet and its load monitoring system.

As can be deduced from the patent document BR 202012012772-0, the device revealed presents, as one of its main issues, inflated cushions that impede the central region to move without there being shearing forces on the fabric. Consequently, these shear forces create creases and water accumulation points during the positioning of the head piece at the ends of the cover, which increases the risk of rupture and significantly increases the load (mass) being supported by the device and, consequently, influences the dimensioning of materials and equipment for moving (structures, motors, pulleys, cables, and the like). In addition, the document BR 202012012772-0 does not provide compensation for the vertical movement of the central portion of the device, as such it is unclear how this movement occurs.

Another solution in the state of the art is provided by patent document U.S. Pat. No. 5,427,491 which refers to a hatch cover for loading of particulate material. This hatch cover is a tent-like fabric structure that has a skirt with dimensions that fit around the hatch and that can be coupled to a hatch periphery to prevent rain, snow, dust, and any other contaminants from entering the hatch. The fabric structure has a sloping roof rising from the skirt towards a top where the fabric is sealed to a spout to deliver particulate material in a space (like a vessel hold) under the fabric. A plurality of cables extends around the periphery of the hatch to the top of the fabric, through which the spout can be positioned and repositioned by changing the length of the fastening cables. The fabric structure can also be supported by creating a positive air pressure under the structure in relation to the ambient atmosphere pressure. Preferably, the fabric structure is a conical structure with edges at the base of the cone. At least one inflatable tube can be embedded in the hatch cover, preferably an edge of the flexible structure, and being elevated above the hatch.

As it is possible to deduce from the patent document U.S. Pat. No. 5,427,491, the device disclosed presents, as one of its main issues, the operation principle of keeping the tent stretched which consists in the use of at least one pressurized inflatable hoop and radially arranged tensioned cables. Although not made clear in the document, the person skilled in the art will understand that the use of inflated hoops in toroidal shape allows for movement of the central region only in the projected circular area of the inflated hoop, which results, once again, in non-uniform loading of the vessel hold. In addition, it is evident that the structure envisaged by U.S. Pat. No. 5,427,491 incurs additional expenses as it depends on at least one hoop and possible aluminum structures, as predicted and shown by its FIG. 2.

Another solution in the state of the art is provided by patent document BR 102015010713-7 which refers to a cover device for protection system for vessel loading with toroidal cushions and protectors against water accumulation. This device is equipped with toroidal cushions kept inflated by an air insufflation system and side protectors to prevent water accumulation in susceptible regions and, consequently, the infiltration of water in the seams of the cushions, which can be compressed and distended according to the required loading tube movement.

However, it is possible to deduce from the patent document BR 102015010713-7 that it describes operation of a cover in an approximately conical form, which allows for variation of its form by means of deformation of inflated toroidal elements and by being supported by tensioned cables. Due to its conical shape, one of the issues that arise from its construction is that the vessel loader is prevented from reaching the corners of the hold, and as such, uniform loading cannot be guaranteed. In addition, its construction is quite complex, requiring intensive use of fabrics and sewing processes, which makes this device expensive and its maintenance complex and equally expensive.

Based on documents like the ones described above, it is evident that the failure to fill the corners of a cargo compartment is a significant disadvantage of state of the art documents, resulting in unused free space which could receive large quantities of bulk cargo, in addition to not complying with the loading plan, which may pose risks to the vessel's structure. The use of these spaces would result in better use of vessels and greater savings in cargo transportation, making the process more profitable.

Other documents in the state of the art that fail to resolve problems such as those cited above include PI 0402481-8, U.S. Pat. No. 3,461,891, DE 91 07 063.5 and U.S. Pat. No. 4,022,232. In addition to the issues mentioned above, other disadvantages present in solutions such as those mentioned herein include static coverage equipment that does not allow for head piece movement in order to fill the vessel hold; fixed-length covers that cannot be adapted to different vessel hold openings; coverings that, in order to increase resistance to tears, have excessive amounts of fabric, thus being expensive both in manufacture and movement thereof, in addition to larger amounts of extra or folded fabric being more susceptible to the formation of unwanted water pockets, due to the additional mass and the risk of load contamination when removing the cover; in addition to covers having structures which are not composed of independent portions, which would facilitate their manufacture and maintenance and would provide better movement and resistance when in use.

There is, therefore, space for a vessel hold cover that eliminates the problems pointed out in the state of the art, and that additionally provides easy storage, uniform distribution of forces in its structure and greater control of its positioning by the loading cover operator of the corresponding vessel hold.

OBJECTIVE OF THE INVENTION PATENT

The objective of the present invention patent is to provide an awning for protecting a cargo in bad weather provided with a cover that is arranged between a head piece and a vessel. Said awning is composed of a plurality of skirts partially stacked over each other, and it is also provided with variable-length elements and tensioned cables radially arranged starting from a head piece.

BRIEF DESCRIPTION OF THE FIGURES

For a better understanding and visualization of the object of the present invention patent, it will now be described with reference to the attached figures, representing the technical effect obtained, in which, schematically:

FIG. 4.1: shows a simplified representation of the awning (100) for protecting a cargo in bad weather in a possible position when in use, showing only the cables (130) from the corners, the head piece (200) and a hoop (122A); and FIG. 4.2: shows a simplified representation of the awning (100) for protecting a cargo in bad weather in a possible position when in use, showing only the cables (130) from the corners, the head piece (200) and a hoop (122B).

DETAILED DESCRIPTION OF THE INVENTION PATENT

Figure 1:
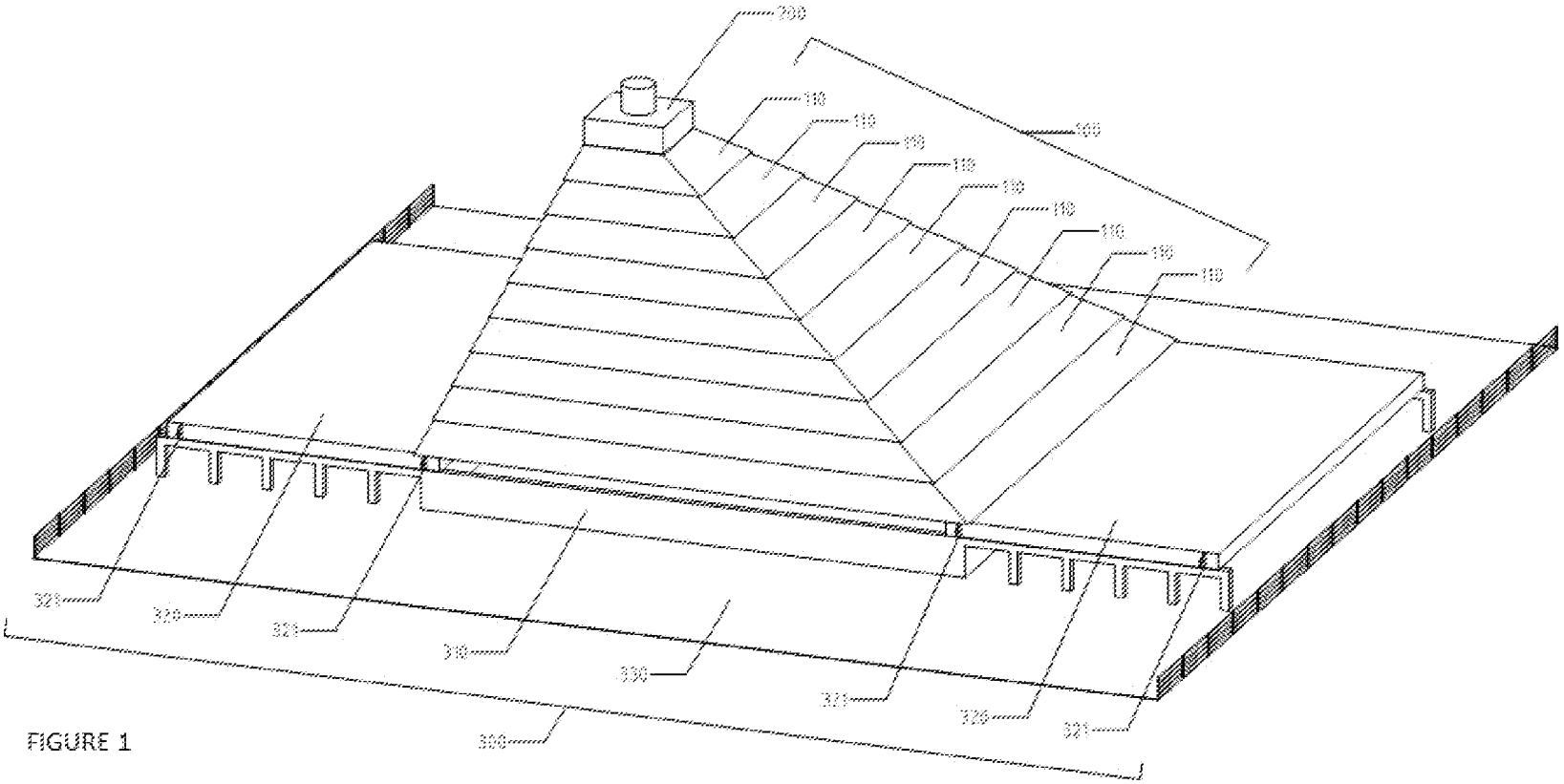
FIG. 1: shows a perspective view of a section of a vessel (300) with the awning (100) for protecting a cargo in bad weather according to the invention installed in one of its holds and connected to the head piece (200)
Figure 2:
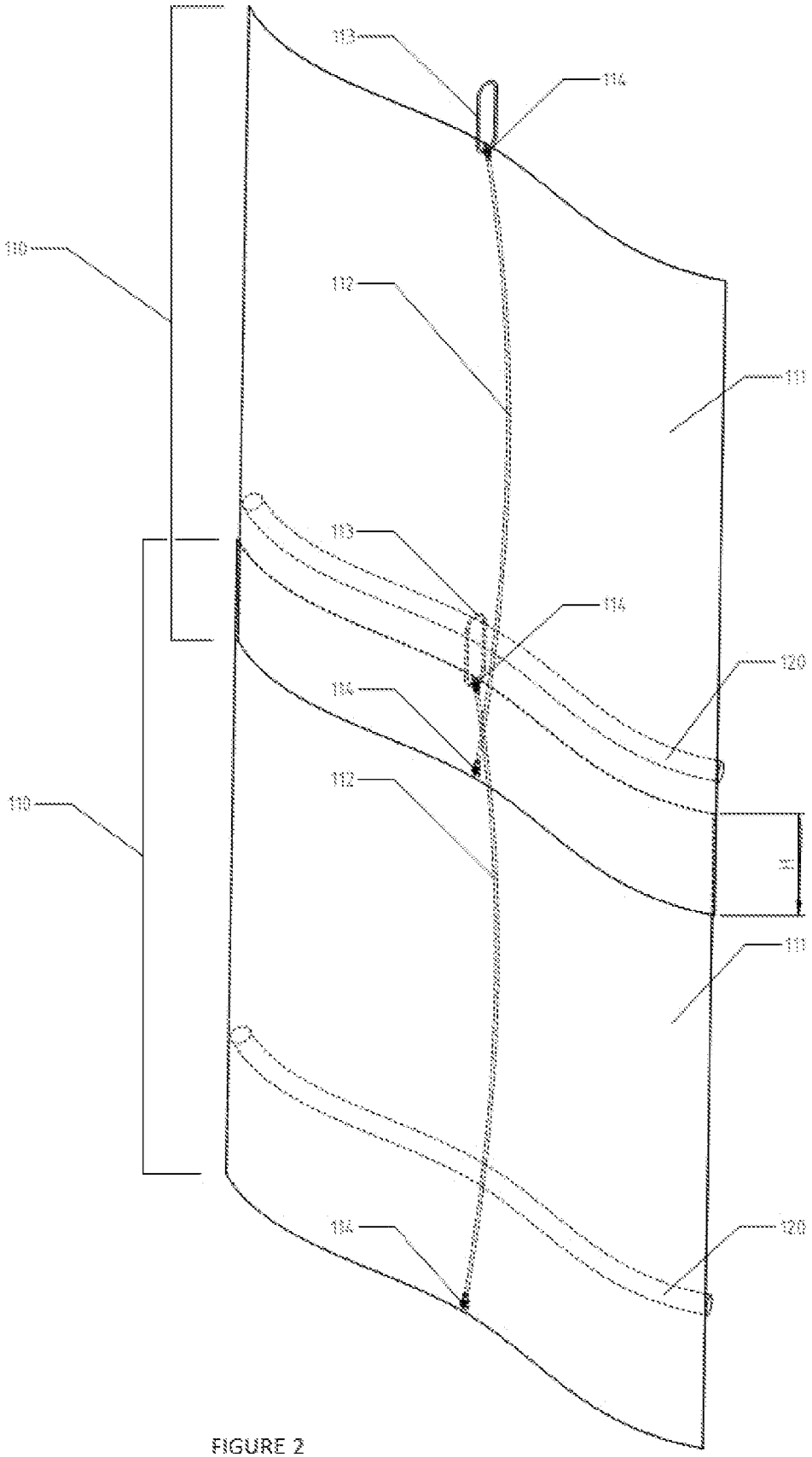
FIG. 2: shows in a perspective view the joining of two skirts (110) composed, each, by a cover (111), flexible rod (112), ring (113) and fixing points (114), in addition to presenting the variable-length elements (120).
Figure 3:
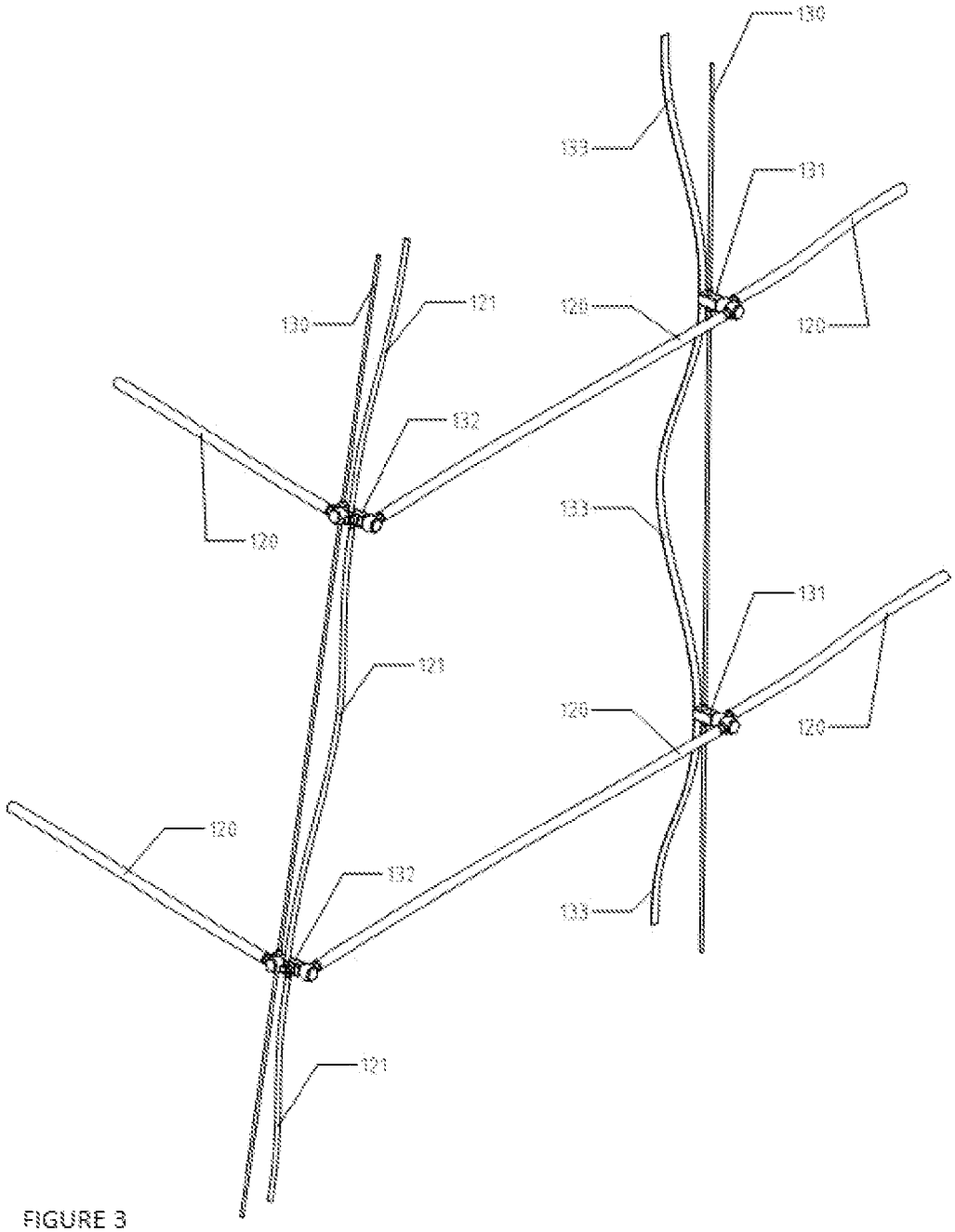
FIG. 3: shows a perspective view of a corner region of the awning (100) without the skirts (110), showing the movement components of the awning (100)

Components of the Awning (100) for Protecting a Cargo in Bad Weather

An awning for protecting a cargo in bad weather according to the present invention basically comprises an awning (100) arranged between a head piece (200) and a vessel (300), being designed, albeit not exclusively, for providing a protective covering during operations for loading vessels (300), more specifically for providing a protective covering for vessel holds (310) when the hatches (320) thereof are open.

The awning (100) is composed of a plurality of skirts (110). Each of these skirts (110) comprises at least one cover (111), at least one flexible rod (112), at least one ring (113) and at least one variable-length element (120).

Each flexible rod (112) is provided with a ring (113) at one of its ends and fixed to at least two fixing points (114) on the cover (111).

According to the present invention, the skirts (110) are supported by the variable-length elements (120), which are arranged between the cover (111) and the flexible rods (112), passing through the rings (113), the rings (113) being therefore responsible for connecting the skirt (110) to the variable-length elements (120).

The variable-length elements (120) are connected to each other by means of connectors (131, 132), forming a plurality of hoops (122). These hoops (122) formed by variable-length elements (120) and by the connectors (131, 132), have perimeters (before operation) that vary starting from the perimeter closest to the head piece (200) up to the perimeter of the vessel hold (310) opening. These hoops (122) slide over cables (130) starting from the head piece (200) and which are fixed in the hatch (320) of the vessel hold (310), generally at fixing points (321) located in said hatches (320), or on the vessel deck (330) through appropriate fixing.

The hoops (122) slide over the cables (130) by means of a specific passageway for the cable (130) present in connectors (131, 132). In order to limit the distance between the hoops (122), one or more flexible limiters (133) interconnect the connectors (131, 132), thus avoiding overloading of the rods (112) or undesirable exposure of the load to bad weather.

The variable-length elements (120) act as artificial muscles, with capacity for volumetric expansion, being able to convert radial expansion into axial contraction. The volume of said variable-length elements (120), already known in the state of the art, may be increased, or reduced by means of an externally controlled external proportional command (not shown), preferably located in the head piece (200).

The variable-length element (120) can be activated by pneumatic, hydraulic, or electric control, but without being restricted to these, the signal being made by means of supply elements (121) that are preferably connected to the head piece (200) and control the instantaneous length of the variable-length elements (120).

The head piece (200) must be equipped with devices and controls known in the state of the art to ensure that all cables (130) are kept under the same tension, regardless of the movement of the head piece (200), aiming to fill the vessel hold (310) with the bulk cargo. Such devices and controls must, in particular, retract or release the cables (130), preferably independently, according to the movement of the head piece (200), for example, by means of pulleys, counterweights, motors of any nature, load cells and other elements suitable to the application.

Operation of the Awning for Protecting a Cargo in Bad Weather

The awning for protecting a cargo in bad weather is fixed on the vessel loading structure (not shown) by means of its head piece (200) and, when not in use, remains retracted and accumulated close to the head piece (200), allowing easier maneuver by the loader.

When it is necessary to protect the cargo during loading, the awning (100) is stretched and fixed at fixing points (321) of the vessel hatches (320) or on the vessel deck (330) by means of appropriate fixing. With the base of the awning (100) attached to the vessel hatches (320), also known as hold doors, the lengths of the variable-length elements (120) are adjusted so that the skirts (110) are equally spaced apart, as shown in FIG. 1.

When adjusting the length of the variable-length elements (120), the skirts (110) are vertically repositioned, as the cables (130), when installed, have an inclination in relation to the vertical axis and angling between the cables, due to approximately radial arrangement thereof. Because of this angling, if a variable-length element (120) has its length reduced by increasing its volume, it will tend to move upwards.

The movement of the head piece (200) is allowed, because once the length of the variable-length elements (120), and consequently the perimeter of the hoops (122), are defined, they will remain in a proportional vertical position, regardless of the movement of the vessel (300) or of the head piece (200), as shown in FIG. 4.

The person skilled in the art will notice that in order for the awning (100) according to the invention to fulfill its role of protecting cargo being deposited inside a vessel (300) hold (310), the covers (111) that make up the skirts (110) are made of a material suitable for the application, preferably resistant, light, waterproof, resistant to the incidence of sunlight, with antistatic properties and properly grounded to prevent electrical discharges inside.

Thus, it is evident that the present invention solves several problems in the state of the art. As it is used coupled to a head piece (200), it allows for filling of the vessel (300) holds (310). Thus, the operation of vessel loading is made more profitable and easier. The awning (100) is made up of skirts (110) partially stacked over each other, so that a higher skirt (110) always has its inferior end stacked over the superior end of the lower adjacent skirt (110), acting in a way that resembles scales or tiles, thus allowing loads to be deposited without contact with external contaminating elements and enabling equal distribution of tensions. Each of the skirts (110) is attached to the variable-length elements (120), both to the superior part by means of the ring (113) and to the inferior part by the flexible rod (112), in order to prevent unintentional opening, for example, due to bad weather. The invention's form of force distribution prevents the formation of tears or gaps that could promote accumulation or infiltration of rainwater, and its pyramidal shape allows greater adaptability to different vessel (300) hold (310) openings. In addition, the independence of the skirts (110) facilitates the removal of sections of the awning (100) for eventual maintenance.

The person skilled in the art will also understand that the increase in the number of variable-length elements (120) independent of each other does not require greater accuracy for the operation. However, it is possible to note that it can imply an increase in the safety of the operation, since the area not supported by variable-length elements (120) and by cables (130) will be smaller, during the action of bad weather, such as gusts of wind.

It will also be easily understood by the person skilled in the art that the awning (100) according to the present invention allows for use of other technologies and devices already known in the state of the art, such as monitoring systems and cameras for viewing the internal space of the awning (100) and the vessel hold (310) being loaded.

Finally, all items that make up the present invention use parts and raw materials known to those skilled in the art, with reduced manufacturing and maintenance costs, making the awning according to the present invention even more profitable. It is also evident to a person skilled in the art that the present invention has easy storage when not in use, with each skirt (110) and its respective cover (111), flexible rod (112) and ring (113) liable to retract towards the head piece (200) when not in use. Thus, the awning (100), when retracted, can be up to 90% smaller than when spread for use.

CONCLUSION

It will be easily understood by those skilled in the art that modifications can be made to the present invention without departing from the concepts set out in the description above. Such modifications should be considered as included within the scope of the present invention. Consequently, the particular embodiments described in detail above are only illustrative and exemplary and are not limiting to the scope of the present invention, which should be given the full extent of the appended claims and any and all equivalents thereof.

The invention claimed is:

1. An awning structure for protecting a cargo in bad weather, the awning structure comprising:

an awning arranged between a head piece and a vessel; and a plurality of skirts partially stacked over each other, so that a higher skirt of the plurality of skirts has an inferior end thereof stacked on a superior end of a lower adjacent skirt of the plurality of skirts;

wherein each of the plurality of skirts includes at least one cover, at least one flexible rod, at least one ring, and at least one variable-length element.

2. The awning structure according to claim 1, wherein the at least one flexible rod of each of the plurality of skirts is provided with the at least one ring at an end thereof and fixed to at least two fixing points in the at least one cover.

3. The awning structure according to claim 1, wherein the plurality of skirts is supported by the variable-length elements, which are arranged between the at least one cover and the flexible rods, passing through the at least one rings.

4. The awning structure according to claim 1, wherein the variable-length elements are connected to each other by connectors, forming a plurality of hoops.

5. The awning structure according to claim 1, wherein the at least one variable-length element has a volume that is increasable or decreasable by a proportional external command.

6. The awning structure according to claim 1, wherein the at least one variable-length element allows for variation of a radial dimension thereof and an axial dimension thereof.

7. The awning structure according to claim 4, wherein the plurality of hoops, formed by the variable-length elements and by the connectors, have perimeters that vary starting from a perimeter closest to the head piece up to a perimeter of a vessel hold opening.

8. The awning structure according to claim 4, wherein the plurality of hoops slide over cables that start from the head piece and are fixed in a hatch of a vessel hold.

9. The awning structure according to claim 4, further comprising one or more flexible limiters interconnect the connectors.

* * * * *